US006204742B1

(12) United States Patent
Hisamoto et al.

(10) Patent No.: US 6,204,742 B1
(45) Date of Patent: Mar. 20, 2001

(54) MAGNETIC SWITCH FOR A STARTER

(75) Inventors: Motoi Hisamoto; Shigeru Shiroyama, both of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/431,783

(22) Filed: Nov. 2, 1999

(30) Foreign Application Priority Data

May 12, 1999 (JP) ..... 11-131464

(51) Int. Cl.[7] ..... H01H 67/02
(52) U.S. Cl. ..... 335/126
(58) Field of Search ..... 200/19.26, 19.36, 200/19.01–19.4; 335/126–131

(56) References Cited

U.S. PATENT DOCUMENTS 4,203,084 * 5/1980 Yamaguchi et al. ..... 335/202
4,825,180 * 4/1989 Miyaji ..... 335/131
4,887,056 * 12/1989 Kajino et al. ..... 335/126
4,987,396 * 1/1991 Bogner ..... 335/126
5,175,524 * 12/1992 Gotoh ..... 335/126
5,428,330 * 6/1995 Tamemoto ..... 335/236
5,569,892 * 10/1996 Shiga et al. ..... 200/19.36
5,631,613 * 5/1997 Niimi et al. ..... 335/126
5,663,699 * 9/1997 Shiroyama ..... 335/126

FOREIGN PATENT DOCUMENTS 56-34690 8/1981 (JP) .

* cited by examiner

*Primary Examiner*—J. R. Scott
(74) *Attorney, Agent, or Firm*—Sughrue, Mion, Zinn, Macpeak & Seas, PLLC

(57) ABSTRACT

A magnetic switch includes a switch case 109, a molded cap 108 fastened to the switch case by crimped portions, two fixed terminals 107 having fixed contact shafts and fixed contacts, and a movable contact 5, wherein the crimped portions are disposed between the fixed terminals and coil terminal conductors in the vicinity of an open end portion of the molded cap to form four crimped portions 109*d* engaging the molded cap by crimping at positions radially further inwards than the inside diameter of the switch case. The outside diameter of the molded cap may be equal to or greater than the outside diameter of the switch case. The cross-sectional shape of the fixed contacts is an octagon and two sides thereof are approximately parallel to the outer circumferential surface of the molded cap.

8 Claims, 5 Drawing Sheets

MAGNETIC SWITCH FOR A STARTER

BACKGROUND OF THE INVENTION

1. Field of the Invention

The present invention relates to a magnetic switch for a starter, and relates in particular to a construction for reducing the size of a magnetic switch.

2. Description of the Related Art

A conventional magnetic switch for a starter may have a construction like that shown in FIGS. 7 and 8, for example. FIG. 7 is an end elevation of a conventional magnetic switch for a starter, and FIG. 8 is a cross-section taken through line VIII—VIII in FIG. 7.

In FIG. 8, an electromagnetic coil 3 wound onto a coil winding frame 2 or a coil bobbin composed of an insulating body and from which lead wires 18 are drawn is housed in a generally cylindrical switch case 9. A thin-walled cylindrical bush 12 is inserted inside the coil winding frame 2 and is secured by fitting into the switch case 9. A cylindrical fixed core 1 composed of a magnetic body having a collar portion 1*a* on an end portion is disposed inside the bush 12. Furthermore, a movable core 10 is disposed inside the bush 12 facing the fixed core 1, and a return spring 11 which is a coil spring is compressed and disposed between the fixed core 1 and the movable core 10.

The switch case 9 houses the electromagnetic coil 3 as well as the fixed core 1, and also houses the movable core 10 so as to be able to slide freely on the inner circumferential surface of the bush 12. An end portion of the hollow cylindrical portion of the switch case 9 is thin-walled and forms a thin-walled portion 9*a* for securing a molded cap 8 molded from resin by crimping. A crimped portion 9*b* is formed on the extreme end of the thin-walled portion 9*a* by roll crimping the thin-walled portion 9*a* of the switch case 9 over a stepped portion 8*b* disposed around the entire circumference of an end portion of the molded cap 8.

A rod-shaped movable contact shaft 4 slidably supported by the fixed core 1 is disposed inside the fixed core 1. Furthermore, a movable contact 5 which is a flat plate-shaped conductor is disposed on the movable contact shaft 4, being held between insulating washers 6 and 13 composed of insulating material and kept electrically insulated from the movable contact shaft 4. A pushing spring 15 which is a coil spring is compressed and disposed between the insulating washer 6 and a collar portion 4*a* of the movable contact shaft 4. On the other hand, a retaining ring 14 is disposed in close proximity to the insulating washer 6, being secured by insertion into a groove on the movable contact shaft 4. Consequently, the movable contact 5 is slidably held on the collar portion 4*a* side of the movable contact shaft 4.

In addition, a return spring 16 which is a coil spring is compressed and disposed between the molded cap 8 and the retaining ring 14 at the molded cap 8 end of the movable contact shaft 4 so as to cover the movable contact shaft 4.

Two fixed contacts 7 comprising generally cylindrical fixed contacts 7*b* for contacting by the movable contact 5, and fixed contact shafts 7*a* which are contact terminal conductors are disposed in positions on an inside portion of the molded cap 8 facing the movable contact 5.

The fixed contacts 7 are inserted through the molded cap 8 and fastened. Sheet-shaped packing 19 is held between the fixed contacts 7*b* and the molded cap 8 to prevent moisture from seeping from outside the molded cap 8 around outer circumferential portions of the fixed contact shafts 7*a* into the inside of the molded cap 8.

As shown in FIG. 7, on the outside of the molded cap 8, the two fixed contacts 7 constitute an M terminal for electrical connection to a starter motor (not shown) and a B terminal for electric connection to a battery (not shown), respectively, and are disposed so as to have a distance L between B-M terminals which is the distance separating the axes of the two fixed contacts 7. Furthermore, threads 7*c* are formed on the fixed contact shafts 7*a* of the fixed contacts 7, and washers 17 forming terminal contact seats connected to the starter motor or the battery are disposed on the threads 7*c*. Furthermore, a partition portion 8a is convexly disposed on the molded cap 8 between the two fixed contacts 7 to increase the insulation between the fixed contacts.

Furthermore, the pushing spring 15 and the return spring 16 keep the two fixed contacts 7*b* and the movable contact 5 in positions where they are separated from each other.

Next, the operation of the above will be explained.

When power is supplied to the electromagnetic coil 3 by means of the lead wires 18 so that the electromagnetic coil 3 is in an energized state, the movable core 10 is attracted towards the fixed core 1 and moves the movable contact shaft 4 towards the molded cap 8. The fixed contacts are electrically connected to each other by the movable contact 5 contacting the two fixed contacts 7*b*. Now, when the movable contact contacts the fixed contacts 7*b*, the pushing spring 15 is compressed and the movable contact shaft 4 and the movable contact 5 are displaced relative to each other, and only the movable contact shaft 4 moves closer to the molded cap 8.

Furthermore, when the electromagnetic coil 3 is no longer energized, the return spring 16 pushes the movable contact away from the fixed contacts 7*b* by elastic force.

In a conventional magnetic switch for a starter such as this, the joining of the molded cap 8 and the switch case 9 has involved forming the outside diameter of the molded cap 8 smaller than the outside diameter of the thin-walled portion 9*a* of the switch case 9 around its entire circumference, and roll crimping the molded cap 8 around its entire circumference with the thin-walled portion 9*a* of the switch case 9 covering the outer circumference of the molded cap 8 to crimp it.

However, when attempts were made to reduce the size of the magnetic switch by making the outside diameter of the switch case 9 smaller, because the thin-walled portion 9*a* of the switch case 9 covers the outer circumference of the molded cap 8, it is necessary to make the outside diameter of the molded cap 8 smaller as well. For that reason, it is difficult to maintain the conventional distance L between B-M terminals.

That is to say, if one tries to keep the distance L between B-M terminals as large as possible, the walls of molded cap 8 become thin, leading to insufficient strength in the molded cap 8 and poor filling of the mold during the manufacture of the molded cap 8.

On the other hand, FIGS. 9 and 10 show the construction of a magnetic switch in a case where the magnetic switch is reduced in size by shortening the distance L between B-M terminals. Hereafter, parts or portions the same as or similar to those in FIGS. 7 and 8 will be given the same numbering and duplicate explanations will be omitted.

FIGS. 9 and 10 differ from FIGS. 7 and 8 in that the distance L between B-M terminals has been shortened. In this case, the conventional battery lead terminal for mounting on the B terminal and the motor lead terminal connected to the motor for mounting on the M terminal are obstructed by the partition portion 8*a* of the molded cap 8 and the lead terminals cannot be mounted.

Furthermore, it becomes difficult to maintain the insulating distance c between the fixed contacts 7*b* and the movable contact shaft 4 in the magnetic switch. In order to maintain sufficient insulating distance c, it is necessary to reduce the contact surface area between the fixed contacts 7*b* and the movable contact 5, undesirably increasing the current density at the contact portion.

SUMMARY OF THE INVENTION

The present invention aims to solve the above problems and an object of the present invention is to provide a small, light-weight magnetic switch for a starter without reducing the distance between the axes of the fixed contacts.

In order to achieve the above object, according to one aspect of the present invention, there is provided a magnetic switch for a starter comprising: a generally cylindrical switch case having a generally circular open end portion; an electromagnetic coil housed inside the switch case; a molded cap having a generally circular open end portion fitting into the open end portion of the switch case fastened to the switch case by crimped portions of the switch case; two contact terminal conductors fastened to the molded cap at positions radially separated from each other relative to the central axis of the molded cap, each having an outside end positioned outside the molded cap and an inside end positioned inside the molded cap; fixed contacts disposed on the inside ends of each of the contact terminal conductors; and a movable contact disposed facing the fixed contacts, placed in and out of contact with the fixed contacts by the action of the electromagnetic coil, the crimped portions of the switch case being disposed in the vicinity of the open end portion of the molded cap only on those portions of the open end portion between the contact terminal conductors looking circumferentially relative to the open end portion, such that there are at least two crimped portions crimped over and engaging the molded cap at positions radially further inwards than the inside diameter of the switch case, and the outside diameter of the molded cap is generally equal to or greater than the outside diameter of the switch case.

According to another aspect of the present invention, the magnetic switch for a starter may also be provided with coil terminal conductors for the electromagnetic coil fastened to and held by the molded cap in positions separated radially relative to the molded cap which are between the contact terminal conductors looking circumferentially relative to the molded cap, wherein the crimped portions are disposed between the contact terminal conductors and the coil terminal conductors looking circumferentially relative to the molded cap.

According to another aspect of the present invention, the cross-sectional shape of the fixed contacts may also be a polygon having four or more vertices.

According to another aspect of the present invention, one side of the cross-sectional shape of the fixed contacts which is positioned close to the open end portion may be generally parallel to the outer circumferential surface of the open end portion of the molded cap.

According to another aspect of the present invention, the movable contact may comprise a movable contact shaft extending along the central axis of the molded cap between the contact terminal conductors, and one side of the cross-sectional shape of the fixed contacts which is positioned close to the movable contact shaft may be generally parallel to the outer circumferential surface of the open end portion of the molded cap.

DETAILED DESCRIPTION OF THE PREFERRED EMBODIMENT

Figure 1:
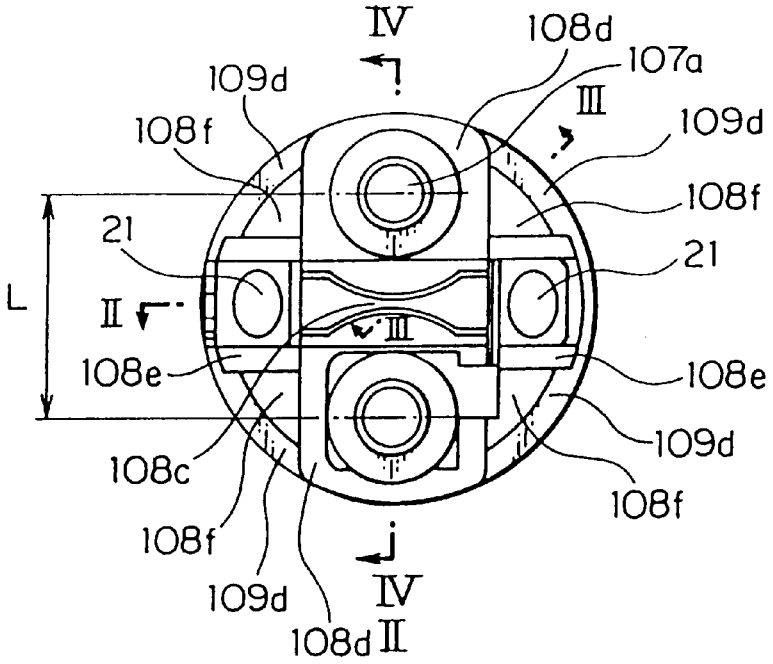
FIG. 1 is a cross-section showing the construction of a magnetic switch for a starter according to the preferred embodiment of the present invention.
Figure 2:
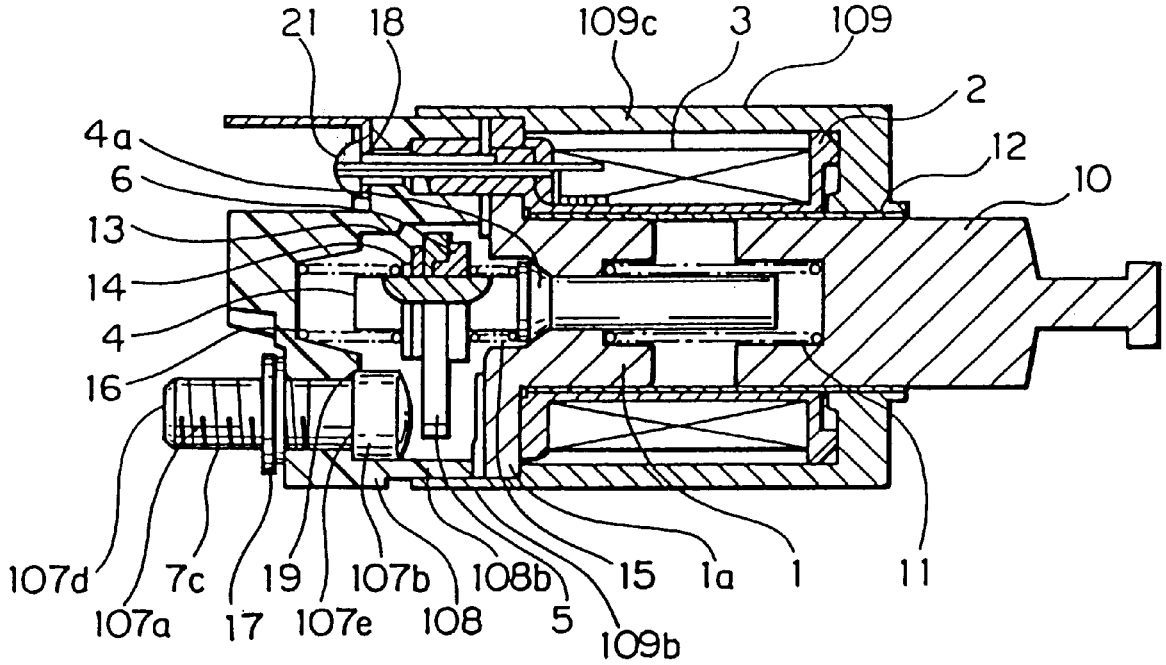
FIG. 2 is a cross-section taken along line II—II in FIG. 1.
Figure 3:
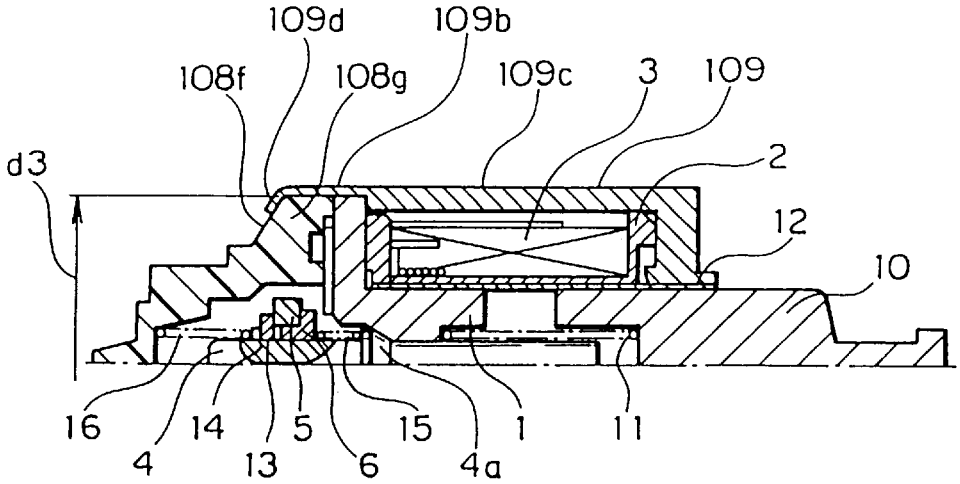
FIG. 3 is a cross-section taken along line III—III in FIG. 1.
Figure 4:
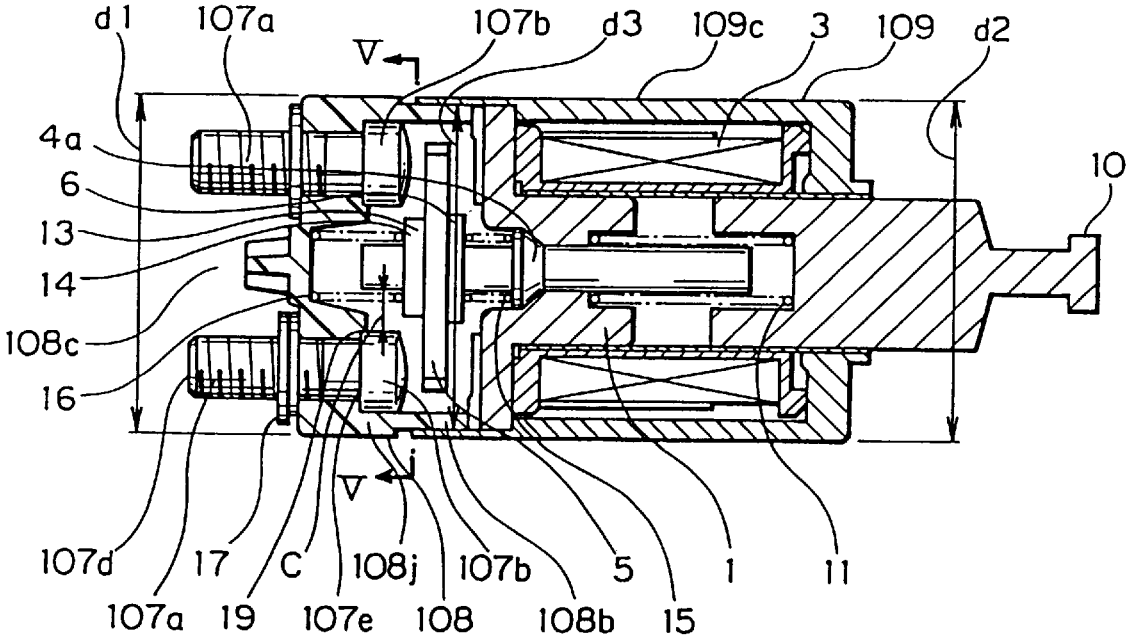
FIG. 4 is a cross-section taken along line IV—IV in FIG. 1.

The preferred embodiment of the present invention will now be explained based on the drawings. FIG. 1 is a cross-section showing the magnetic switch for a starter which is the preferred embodiment of the present invention, and a perspective view of the outside of part of this magnetic switch for a starter from a side thereof. Furthermore, FIG. 2 is a cross-section taken along line II—II in FIG. 1, FIG. 3 is a cross-section taken along line III—III in FIG. 1, and FIG. 4 is a cross-section taken along line IV—IV in FIG. 1.

First, the construction of this magnetic switch for a starter will be explained based on FIG. 2 with reference to the other drawings as well. In FIG. 2, an electromagnetic coil 3 wound onto a coil winding frame 2 or a coil bobbin composed of an insulating body and from which lead wires 18 are drawn is housed in a generally cylindrical switch case 109. A thin-walled cylindrical bush 12 is inserted inside the coil winding frame and is secured by fitting into the switch case 109. A cylindrical fixed core 1 composed of a magnetic body having a collar portion 1*a* on an end portion is disposed inside the bush 12. Furthermore, a movable core 10 is disposed inside the bush 12 facing the fixed core 1, and a return spring 11 which is a coil spring is compressed and disposed between the fixed core 1 and the movable core 10.

A cylindrical rod-shaped movable contact shaft 4 slidably supported by the fixed core 1 is disposed inside the fixed core 1. Furthermore, a movable contact 5 which is a flat plate-shaped conductor is disposed on the movable contact shaft 4, being held between insulating washers 6 and 13 composed of insulating material and kept electrically insulated from the movable contact shaft 4. A pushing spring 15 which is a coil spring is compressed and disposed between the insulating washer 6 and a collar portion 4*a* of the movable contact shaft 4. On the other hand, a retaining ring 14 is disposed in close proximity to the insulating washer 6, being secured by insertion into a groove on the movable contact shaft 4. Consequently, the movable contact 5 is slidably held on the collar portion 4*a* side of the movable contact shaft 4.

In addition, a return spring 16 which is a coil spring is compressed and disposed between a molded cap 108 molded from resin and the retaining ring 14 on an end portion of the movable contact shaft 4 so as to cover the movable contact shaft 4.

Two fixed terminals comprising generally octagonal prism-shaped fixed contacts 107*b* for contacting by the movable contact 5, and fixed contact shafts 107*a* which are contact terminal conductors are disposed in positions on an inside portion of the molded cap 108 facing the movable contact 5.

The fixed contact shafts 107*a* are inserted through and fastened to the molded cap 108 at positions radially separated from each other relative to the central axis 108*c* of the molded cap 108, having outside ends 107*d* positioned outside the molded cap 108 and inside ends 107*e* positioned inside the molded cap 108. Furthermore, the fixed contacts 107*b* disposed on the inside ends 107*e* of the fixed contact shafts 107*a* are formed integrally with the fixed contact shafts 107*a* and constitute fixed terminals.

The fixed contacts 107*b* are disposed facing the movable contact 5, and the movable contact 5 is placed in and out of contact with the fixed contacts 107*b* by the action of the electromagnetic coil 3.

Sheet-shaped packing 19 is held between the fixed contacts 107*b* and the molded cap 108 to prevent moisture from seeping from outside the molded cap 108 around outer circumferential portions of the fixed contact shafts 107*a* into the inside of the molded cap 108.

A thin-walled generally circular open end portion 109*b* is formed in an end portion of a cylindrical portion 109*c* of the switch case 109.

Meanwhile, a generally circular open end portion 108*b* fitting into the open end portion 109*b* of the switch case 109 is disposed in the molded cap 108.

Figure 6:
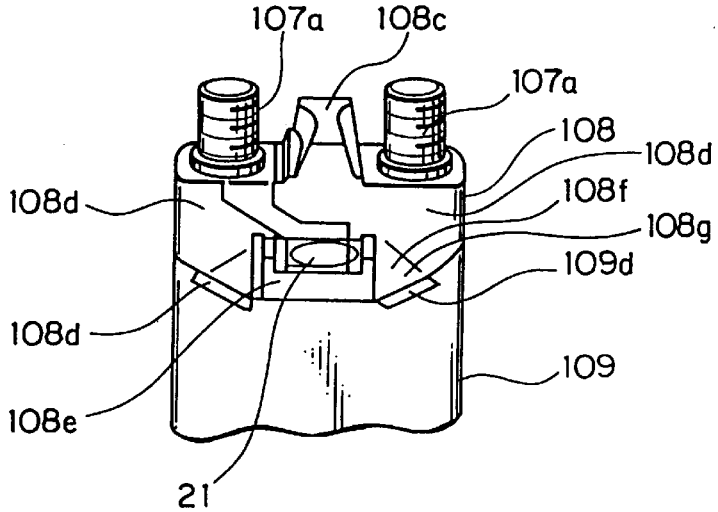
FIG. 6 is a perspective showing the construction of a magnetic switch for a starter according to the preferred embodiment of the present invention.
Figure 7:
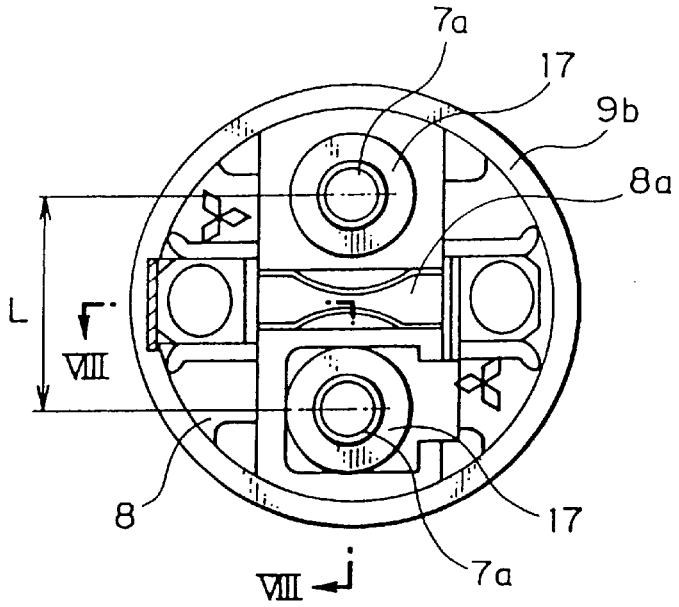
FIG. 7 PRIOR ART
FIG. 7 is a cross-section showing the construction of a conventional magnetic switch for a starter.
Figure 8:
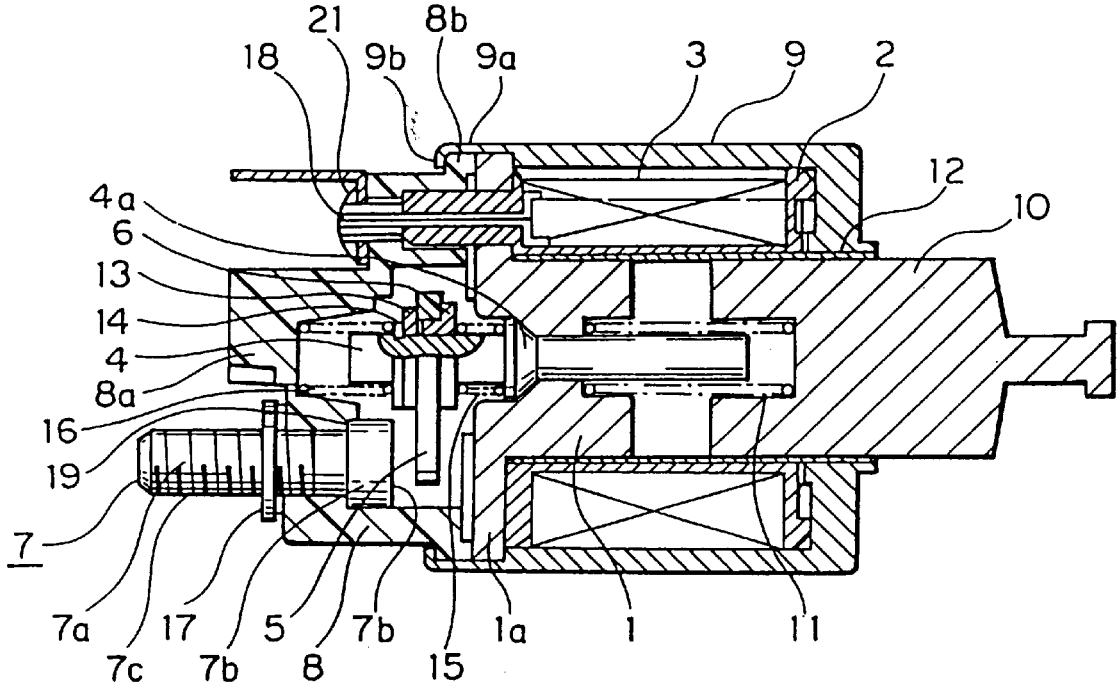
FIG. 8 PRIOR ART
FIG. 8 is a cross-section taken along line VIII—VIII in FIG. 7.
Figure 9:
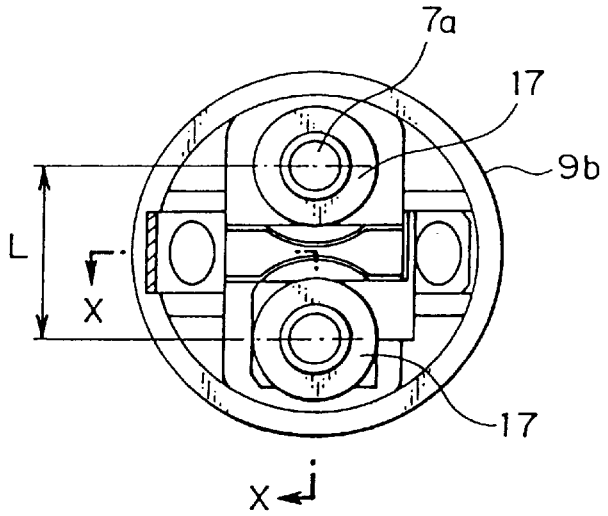
FIG. 9 PRIOR ART
FIG. 9 is a cross-section showing the construction of another conventional magnetic switch for a starter.
Figure 10:
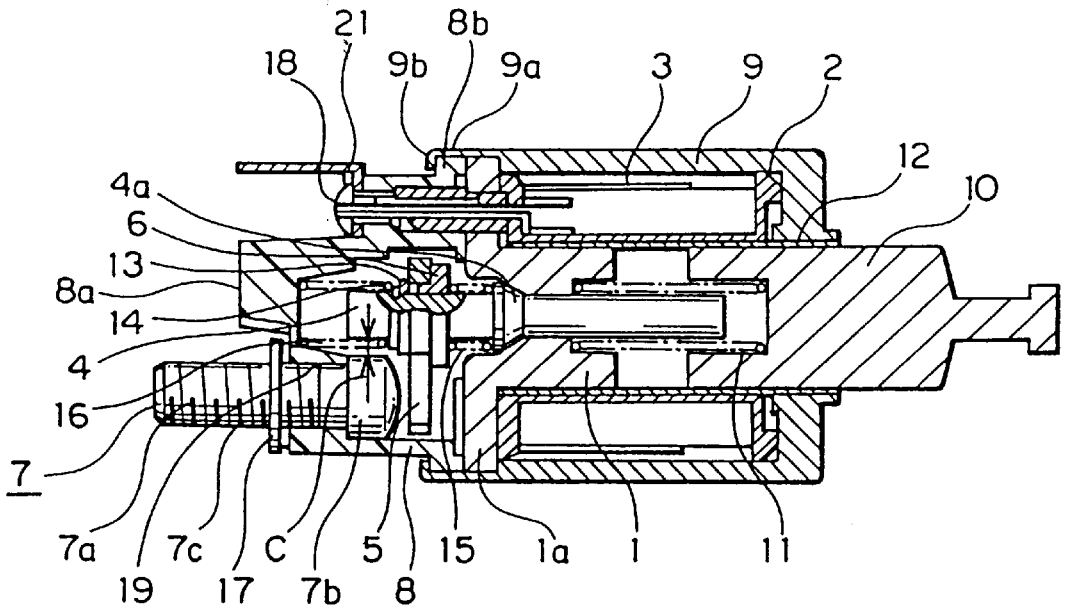
FIG. 10 PRIOR ART
FIG. 10 is a cross-section taken along line X—X in FIG. 9.

As shown in FIG. 6, lead wire terminals 21 which are coil terminal conductors for the electromagnetic coil 3 which are fastened to and supported by the molded cap 108 are disposed in positions radially separated relative to the molded cap 108 which are between the contact terminal conductors or the fixed contact shafts 107*a* looking circumferentially relative to the molded cap 108 rotated approximately 90 degrees circumferentially around the molded cap 108 relative to the fixed contact shafts 107*a*. The lead wire terminals 21 constitute extreme end portions of the lead wires 18 of the electromagnetic coil 3.

The fixed contacts 107*a* are inserted through boss portions 108*d* of the molded cap 108 and the lead wire terminals 21 are secured to boss portions 108*e*, and four recesses 108*f* gouged out of the boss portions 108*d*, 108*e* are disposed between the boss portions 108*d*, 108*e*, forming stepped portions 108*g* (see FIG. 3)

In FIG. 3, parts of the open end portion 109*b* of the switch case 109 are secured by crimping to the stepped portions 108*f*, forming crimped portions 109*d*.

The crimped portions 109*d* are disposed in the vicinity of the open end portion 108*b* of the molded cap 108 only between the two fixed contact shafts 107*a* looking circumferentially relative to the open end portion 108*b*, and are engaged by crimping over the molded cap 108 at positions radially further inwards than the inside diameter d3 of the switch case 109. Here, the outside diameter d1 of the molded cap 108 is approximately the same as or greater than the outside diameter d2 of the switch case (see FIG. 4).

Figure 5:
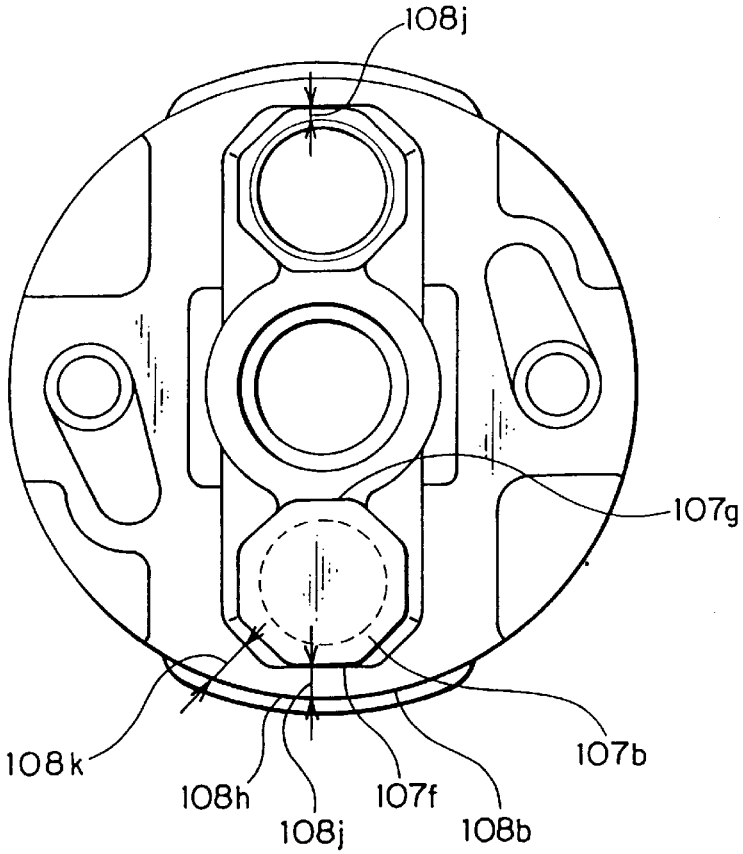
FIG. 5 is a view from the direction of the arrows V—V in FIG. 4.

FIG. 5 is a view from the direction of the arrows V—V in FIG. 4 and shows the shape of the inside of the molded cap and the shapes of the fixed contacts. To facilitate explanation, one of the two fixed contacts 107*b* has been removed from the diagram to make the shape of the inside of the molded cap 108 easier to see.

The cross-sectional shape of the fixed contacts 107*b* is formed into a polygon having four or more vertices, in this case an octagon. Furthermore, one of the sides of the octagon, side 107*f*, which is positioned close to the open end portion 108*b* is generally parallel to the outer circumferential surface 108*h* of the open end portion 108*b* of the molded cap 108. In addition, one of the sides of the octagon, side 107*g*, which is positioned close to the movable contact shaft 4 is also generally parallel to the outer circumferential surface 108*h* of the open end portion 108*b* of the molded cap 108.

According to the preferred embodiment of the present invention, because the crimped portions 109*d* are disposed in the vicinity of the open end portion 108*b* of the molded cap 108 only between the two fixed contact shafts 107*a* looking circumferentially relative to the open end portion 108*b*, and are engaged by crimping over the molded cap 108 at positions radially further inwards than the inside diameter d3 of the switch case 109, the magnetic switch can be reduced in size while maintaining the thickness of the molded cap 108 without shortening the distance L between B-M terminals of the molded cap 108. Furthermore, conventional lead terminals for connection to the B terminal and the M terminal can be mounted without modification. Furthermore, when mounting the lead terminals on the B terminal and the M terminal, because the portion 108*j* (see FIG. 4) of the molded cap 108 subjected to fastening torque during mounting of the lead terminals can be maintained at the conventional thickness, cracks are not generated in the molded cap 108. Furthermore, because the distance between the B-M terminals is not shortened, the insulating distance c between the fixed contacts 107*b* and the movable contact shaft 4 can be maintained at the conventional distance.

In addition, because the cross-sectional shape of the fixed contacts 107*b* is formed into an octagon, the applied area of the packing 19 on the fixed contacts 107*b* is sufficiently ensured, preventing moisture from seeping into the molded cap. Furthermore, the thickness portion 108*k* of the open end portion 108*b* of the molded cap 108 near the fixed contacts 107*b* can be increased.

Furthermore, because side 107*f* of the octagon is generally parallel to the outer circumferential surface 108*h* of the open end portion 108*b* of the molded cap 108, the portion 108*j* of the molded cap 108 subjected to the fastening torque accompanying mounting of the lead terminals can be made thicker. Because side 107*g* of the octagon is also generally parallel to the outer circumferential surface 108*h* of the open end portion 108*b* of the molded cap 108, the insulating distance c between the fixed contacts 107*b* and the movable contact shaft 4 can be even more sufficiently allowed for.

By the magnetic switch for a starter according to the present invention, there is provided a magnetic switch for a starter comprising: a generally cylindrical switch case having a generally circular open end portion; an electromagnetic coil housed inside the switch case; a molded cap having a generally circular open end portion fitting into the open end portion of the switch case fastened to the switch case by crimped portions of the switch case; two contact terminal conductors fastened to the molded cap at positions radially separated from each other relative to the central axis of the molded cap, each having an outside end positioned outside the molded cap and an inside end positioned inside the molded cap; fixed contacts disposed on the inside ends of each of the contact terminal conductors; and a movable contact disposed facing the fixed contacts, placed in and out of contact with the fixed contacts by the action of the electromagnetic coil, the crimped portions of the switch case being disposed in the vicinity of the open end portion of the molded cap only on those portions of the open end portion between the contact terminal conductors looking circumferentially relative to the open end portion, such that there are at least two crimped portions crimped over and engaging the molded cap at positions radially further inwards than the inside diameter of the switch case, and the outside diameter of the molded cap is generally equal to or greater than the outside diameter of the switch case. Therefore a small, light-weight magnetic switch is provided while maintaining the thickness of the molded cap without shortening the distance L between B-M terminals. Furthermore, conventional lead terminals for connection to the B terminal and the M terminal can be mounted without modification. Furthermore, when mounting the lead terminals on the B terminal and the M terminal, because the portion of the molded cap subjected to fastening torque during mounting of the lead terminals can be maintained at the conventional thickness, cracks are not generated in the molded cap. Furthermore, because the distance between the B-M terminals is not shortened, the insulating distance between the fixed contacts and the movable contact shaft can be maintained at the conventional distance.

By the magnetic switch for a starter according to the present invention, the magnetic switch for a starter may also be provided with coil terminal conductors for the electromagnetic coil fastened to and held by the molded cap in positions separated radially relative to the molded cap which are between the contact terminal conductors looking circumferentially relative to the molded cap, wherein the crimped portions are disposed between the contact terminal conductors and the coil terminal conductors looking circumferentially relative to the molded cap. Accordingly, the size of the switch case to be reduced independent of the position where the coil terminal conductors for the electromagnetic coil are mounted.

By the magnetic switch for a starter according to the present invention, the cross-sectional shape of the fixed contacts may also be a polygon having four or more vertices, enabling the applied area of the packing on the fixed contacts to be sufficiently ensured, preventing moisture from seeping into the molded cap. Furthermore, the thickness portion of the open end portion of the molded cap near the fixed contacts can be increased.

By the magnetic switch for a starter according to the present invention, one side of the cross-sectional shape of the fixed contacts which is positioned close to the open end portion may be generally parallel to the outer circumferential surface of the open end portion of the molded cap, enabling the portion of the molded cap subjected to the fastening torque accompanying mounting of the lead terminals to be made thicker.

By the magnetic switch for a starter according to the present invention, the movable contact may comprise a movable contact shaft extending along the central shaft core of the molded cap between the contact terminal conductors, and one side of the cross-sectional shape of the fixed contacts which is positioned close to the movable contact shaft may be generally parallel to the outer circumferential surface of the open end portion of the molded cap, enabling the insulating distance between the fixed contacts and the movable contact shaft to be even more sufficiently allowed for.

What is claimed is:

1. A magnetic switch for a starter, comprising:

a generally cylindrical switch case (109) having a generally circular open end portion (109*b*);

an electromagnetic coil armature (3) housed inside said switch case;

a molded cap (108) having a generally circular open end portion (108*b*) fitting into said open end portion of said switch case and fastened to said switch case by discrete, interrupted crimped portions (109*d*) of said switch case;

two contact terminal conductors (107) fastened to said molded cap at positions diametrically opposite from each other relative to a central axis of said molded cap, each contact terminal conductor having an outside end positioned outside said molded cap and an inside end positioned inside said molded cap;

fixed contacts (107*b*) disposed on said inside ends of each of said contact terminal conductors; and a movable contact assembly (5) disposed facing said fixed contacts, placed in and out of contact with said fixed contacts by the action of said electromagnetic coil armature, wherein:

said discrete, interrupted crimped portions of said switch case are disposed in a vicinity of said open end portion of said molded cap only on circumferential portions thereof flanking said contact terminal conductors, at least two crimped portions extend over and engage said molded cap at positions radially further inwards than an inside diameter of said switch case, and an outside diameter of said molded cap is at least equal to an outside diameter of said switch case at uncrimped positions radially outward from said contact terminal conductors.

2. The magnetic switch for a starter according to claim 1, further comprising coil terminal conductors (21) for said electromagnetic coil fastened to and held by said molded cap in positions separated radially diametrically relative to said molded cap which are between said contact terminal conductors looking circumferentially relative to said molded cap, wherein said crimped portions are disposed between said contact terminal conductors and said coil terminal conductors looking circumferentially relative to said molded cap.

3. The magnetic switch for a starter according to claim 2, wherein the cross-sectional shape of said fixed contacts is a polygon having four or more vertices.

4. The magnetic switch for a starter according to claim 3, wherein one side of said cross-sectional shape of said fixed contacts which is positioned close to said open end portion is generally parallel to the outer circumferential surface of said open end portion of said molded cap.

5. The magnetic switch for a starter according to claim 3, wherein said movable contact assembly comprises a movable contact shaft extending along the central axis of said molded cap between said contact terminal conductors; and one side of said cross-sectional shape of said fixed contacts which is positioned close to said movable contact shaft is generally parallel to the outer circumferential surface of said open end portion of said molded cap.

6. The magnetic switch for a starter according to claim 1, wherein the cross-sectional shape of said fixed contacts is a polygon having four or more vertices.

7. The magnetic switch for a starter according to claim 6, wherein one side of said cross-sectional shape of said fixed contacts which is positioned close to said open end portion is generally parallel to the outer circumferential surface of said open end portion of said molded cap.

8. The magnetic switch for a starter according to claim 6, wherein said movable contact assembly comprises a movable contact shaft extending along the central axis of said molded cap between said contact terminal conductors; and one side of said cross-sectional shape of said fixed contacts which is positioned close to said movable contact shaft is generally parallel to the outer circumferential surface of said open end portion of said molded cap.

* * * * *